United States Patent [19]

Benson

[11] Patent Number: 4,475,733

[45] Date of Patent: Oct. 9, 1984

[54] ENHANCED PADDLE WHEEL INERTIAL SEPARATOR AND TRANSPORTER

[75] Inventor: Richard C. Benson, Pittsford, N.Y.

[73] Assignee: Xerox Corporation, Stamford, Conn.

[21] Appl. No.: 404,256

[22] Filed: Aug. 2, 1982

[51] Int. Cl.[3] ..... B65H 3/06

[52] U.S. Cl. ..... 271/120; 221/222; 221/259; 221/260

[58] Field of Search ..... 271/120; 221/222, 259, 221/260, 277; 222/352

[56] References Cited

U.S. PATENT DOCUMENTS

| | | | |
|---|---|---|---|
| 311,340 | 1/1885 | Loffelhardt | 271/63 X |
| 985,592 | 2/1911 | Hodgkinson | 271/120 |
| 2,755,086 | 7/1956 | Lubersky | 271/36 |
| 3,220,605 | 11/1965 | Casey | 221/231 |
| 3,630,516 | 12/1971 | Hong | 271/36 |
| 3,669,447 | 6/1972 | Turner et al. | 271/53 |
| 3,690,537 | 9/1972 | Turner et al. | 227/88 |
| 4,043,549 | 8/1977 | Rinehart | 271/118 |
| 4,222,556 | 9/1980 | Chapman et al. | 271/3.1 |
| 4,381,860 | 5/1983 | Silverberg | 271/120 |

FOREIGN PATENT DOCUMENTS

| | | | |
|---|---|---|---|
| 108464 | 1/1899 | Fed. Rep. of Germany | 271/120 |

*Primary Examiner*—Duane A. Reger
*Assistant Examiner*—James E. Barlow
*Attorney, Agent, or Firm*—William A. Henry, II

[57] ABSTRACT

An apparatus for feeding individual substrates from the top of a stack of substrates includes a paddle wheel having a hub with a plurality of blades attached thereto. The paddle wheel is positioned in driving relation to the substrate stack. As the paddle wheel is rotated, the blades come in contact with a spiral track which retards the motion of the blade tips through controlled bending and thereby stores potential energy in the blades. Continued rotation of the paddle wheel allows the blades to spring forward from the track just prior to or during substrate contact thereby changing the potential energy of the blades into kinetic energy. The sudden acceleration of the blades due to the change from potential to kinetic energy causes an increase in inertial separation of the top substrate in the stack from the remainder of the stack.

1 Claim, 4 Drawing Figures

ENHANCED PADDLE WHEEL INERTIAL SEPARATOR AND TRANSPORTER

BACKGROUND OF THE INVENTION

This invention relates generally to an electrophotographic printing machine, and more particularly concerns an improved paddle wheel substrate feeding system for feeding substrates, which term is used herein to include sheets of any type, from a stack along a predetermined path.

Several types of sheet feeders have been used in the past with varying degrees of success. For example, sheet separation with a belt and retard roller appear in the sheet handling art at least as early as 1916 in U.S. Pat. No. 1,167,367 to P. L. Wells and as recently as 1969 in U.S. Pat. No. 3,469,834 to Stange et al. The separation belt and retard roller are employed in these patents for queuing and advancing the sheets but not for separating them from the stack. In these patents, the region of contact between the roller and belt form a sheet queuing throat which is able to "fan out" or queue sheets passed through it. The sheets are separated from a stack and fed to the throat by a presser foot in the Wells, U.S. Pat. No. 1,167,367 and by a nudger or feed wheel in the Stange et al., U.S. Pat. No. 3,469,834.

In addition, numerous devices such as impact/paddle feeders of the type disclosed in U.S. Pat. No. 3,630,516 have been employed to minimize the possibility of misfeeds or multi-feeds. The continued search for feeders that minimize mis-feeds and multi-feeds and can handle wider ranges of copy paper or documents has been necessitated by the complexity of modern sheet processing machines, such as, printers, sorters, collators, reproduction machines, etc., since a mis-feed or multi-feed causes machine shut downs. As an improvement, the present top feeder combines a paddle wheel with an enhancement for better performance in the form of an energy storage means to provide for low cost but reliable single sheet separation and feeding from a stack.

Some present paddle wheel feeders are designed so that the spinning blades vibrate freely when not in contact with a substrate to be fed. The kinetic energy of rotation, which is transferred to the substrate during blade contact, can either feed the top substrate in a stack by jerking it free of the underlying sheets via a rapid loading from the spinning blade, or transport the substrate over distances. The present invention is designed to enhance performance of paddle wheel feeders of the above described type.

SUMMARY OF THE INVENTION

Accordingly, in one aspect of the present invention, an enhanced high acceleration high input paddle wheel substrate feeder comprises in combination, support means for supporting a stack of substrates, paddle wheel means having a plurality of blades thereon and located in driving relation to said stack of substrates, energy storage means adapted to bend said blades during rotation of said paddle wheel means and at a predetermined point during the rotation of said paddle wheel release said blades whereby said blades flick against the top substrate in the stack and separates the substrate from the adjacent substrate in the stack.

In yet another embodiment of the present invention, a substrate paddle wheel feeder is disclosed that comprises support means for supporting a stack of substrates, paddle wheel means having a plurality of blades thereon and mounted above said stack of substrates for feeding substrates from said stack, and energy storage means adapted to bend the blades of said paddle wheel means as it is rotated to store potential energy in the blades by controlled bending so that as the paddle wheel means is rotated, the bent blades are released from the energy storage means and flick against the top substrate in the stack separating that substrate from the remaining substrates in the stack, said energy storage means is positioned above the stack such that the blades both separate and transport the sheet forward for further processing.

BRIEF DESCRIPTION OF THE DRAWINGS

The foregoing and other features of the instant invention will be more apparent from a further reading of the specification and claims and from the drawings in which:

While the present invention will be described hereinafter in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
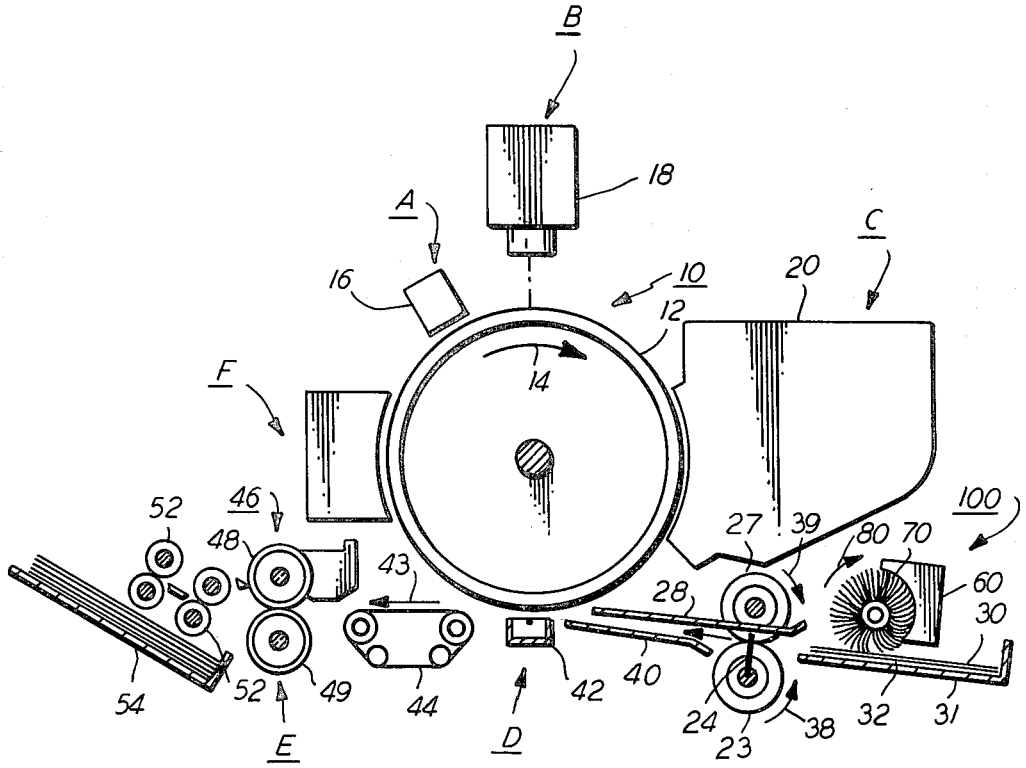
FIG. 1 is a schematic elevational view of an electrophotographic printing machine incorporating the features of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in its application to the particular embodiment shown herein. For example, the apparatus of the present invention will be described hereinafter with reference to feeding successive copy sheets, however, one skilled in the art, will appreciate that it may also be employed for feeding successive original documents.

Since the practice of electrophotographic printing is well known in the art, the various processing stations for producing a copy of an original document are represented in FIG. 1 schematically. Each process station will be briefly described hereinafter.

As in all electrophotographic printing machines of the type illustrated, a drum 10 having a photoconductive surface 12 entrained bout and secured to the exterior circumferential surface of a conductive substrate is rotated in the direction of arrow 14 through the various processing stations. By way of example, photoconductive surface 12 may be made from selenium of the type described in U.S. Pat. No. 2,970,906 issued to Bixby in 1961. A suitable conductive substrate is made from aluminum.

Initially, drum 10 rotates a portion of photoconductive surface 12 through charging station A. Charging station A employs a corona generating device, indicated generally by the reference numeral 16, to charge photoconductive surface 12 to a relatively high substantially uniform potential. A suitable corona generating device is described in U.S. Pat. No. 2,836,725 issued to Vyverberg in 1958.

Thereafter drum 10 rotates the charged portiion of photoconductive surface 12 to exposure station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the information areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by sheet feeding apparatus 100 to transfer station D. Sheet feed apparatus 100 advances successive copy sheets to forwarding registration rollers 23 and 27. Forwarding registration roller 23 is driven conventionally by a motor (not shown) in the direction of arrow 38 thereby also rotating idler roller 27 which is in contact therewith in the direction of arrow 39. In operation, feed device 100 operates to advance the uppermost substrate or sheet from stack 30 into registration rollers 23 and 27 and against registration fingers 23. Fingers 24 are actuated by conventional means in timed relation to an image on drum 12 such that the sheet resting against the fingers is forwarded toward the drum in synchronism with the image on the drum. A conventional registration finger control system is shown in U.S. Pat. No. 3,902,715 which is incorporated herein by reference to the extent necessary to practice this invention. After the sheet is released by finger 24, it is advanced through a chute formed by guides 28 and 40 to trnasfer station D.

Continuing now with the various processing stations, transfer station D includes a corona generating device 42 which applies a spray of ions to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by conventional rollers 52 to catch tray 54.

Invariably, after the copy sheet is separated from photoconductive surface 12, some residual toner particles remain adhering thereto. Those toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 1 depicts the top feeder system in greater detail.

Figure 2:
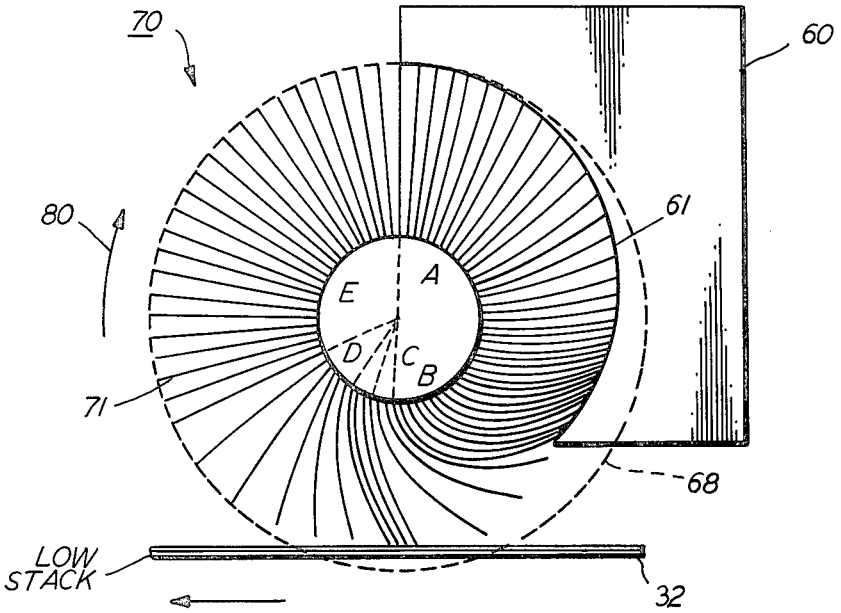
FIG. 2 is an enlarged partial side view of the enhanced inertial separator paddle wheel feeder shown in FIG. 1, and shows blade shapes at 5° intervals.

Referring now more specifically to FIGS. 1 and 2, the detailed structure and operation of an aspect of the present invention will be described. Sheets 32 of stack 30 are shown stacked on platform 31 that has a conventional lift mechanism therein (not shown), such as springs, or an elevator that maintains the stack in correct striking distance to the feed members. This aspect of the invention combines inertial separation with potential energy storage means to separate sheets individually from a stack. The energy storage means controls and increases the ratio of blade and tip velocity to rotational velocity. As can be seen more clearly in FIG. 2, upon rotation of paddle wheel 70 by conventional means (not shown) in the direction of arrow 80, at position (A) a very smooth, inward spiraling track 61 bends and compresses the paddle wheel blades 71 back storing potential energy. The track 61 is long and gently slopes away from the circle shown in dotted line 68 and has a low coefficient of friction in order to minimize drag wear on the blade tips.

Continued rotation of the paddle wheel to section (B) shows the blades 71 springing free of the track and accelerating forward as the potential energy is converted into kinetic energy. The spin frequency of the paddle wheel hub is such that the forward acceleration of the blades peak at the time of impact with the paper or substrate. This occurs at a time ¼T after each blade leaves the track, where T is the natural period of a freely spinning, vibrating blade.

At (C) of FIG. 2, the blades hit the paper with a peak inertial force due to the acceleration of the blades realized from energy storage means 60. This enhances the inertial separating capability of the paddle wheel. After the top sheet breaks free of the lower sheets, it is carried along by the blade striking it during the remainder of its contact with the sheet. Upon reaching point (D), the blades are free from the paper and return to their free spinning shape via a damped oscillation. At point (E), the blades have straightened completely and are ready to begin the next cycle. In this embodiment, the paddle wheel and energy storage means are located such that only the tips of the blades strike the sheets.

Figure 3:
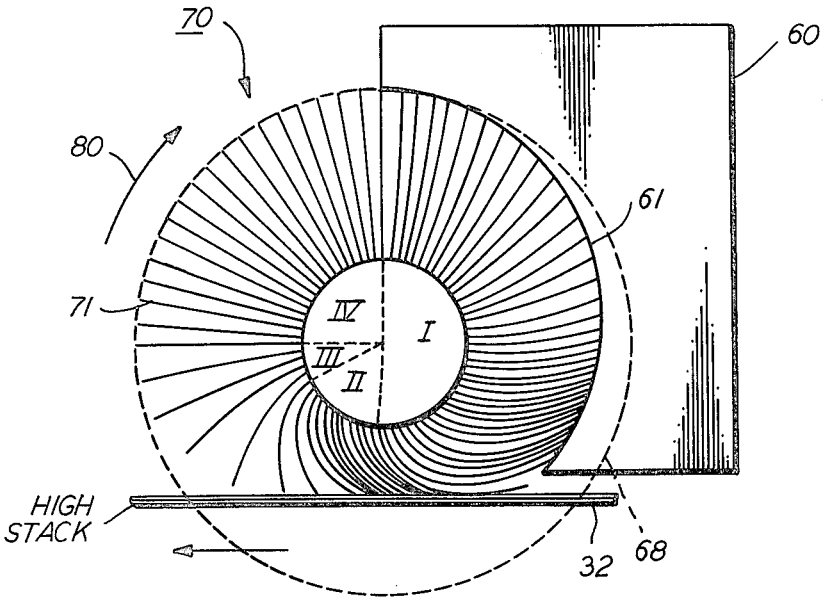
FIG. 3 is an enlarged partial side view of an enhanced inertial separator and transporter paddle wheel system according to another aspect of the present invention which could be employed in the copying machine schematically shown in FIG. 1.

The embodiment of the invention shown in FIG. 3 discloses the enhanced paddle wheel feeder system of FIGS. 1 and 2 with the additional capability added of transporting the sheets over a predetermined length. This improvement is accomplished by positioning the paddle wheel and energy storage means closer to the stack of substrates 32. As shown at (I) of FIG. 3, blades 71 of paddle wheel 70 are bent back by spiral track 61 of energy storage means 60. Due to the backward bending of the blades as shown at (II), and the high position of the paper stack, an intermediate point along the blade length, and not the tip, is the first to contact the paper. The height of the stack can be adjusted so that when blade contact is made the contact point, or "knuckle", is moving approximately horizontally, giving greatest impetus to separating sheets rather than compressing them together. In reference to individual blades, the tip of a blade could still be in the track at the time the knuckle contacts the paper. The potential energy of the blade is gradually released as the blade slides across the paper and straightens out. Contact duration between the blades and paper in this high stack configuration is long which makes this paddle wheel feeder a paper transporter also. In section III, the blades spring or flick free of the paper and start returning to their naturally straight configuration. As shown in section IV, the blades have completed their return to original forms and are now ready to begin the next feed cycle.

Figure 4:
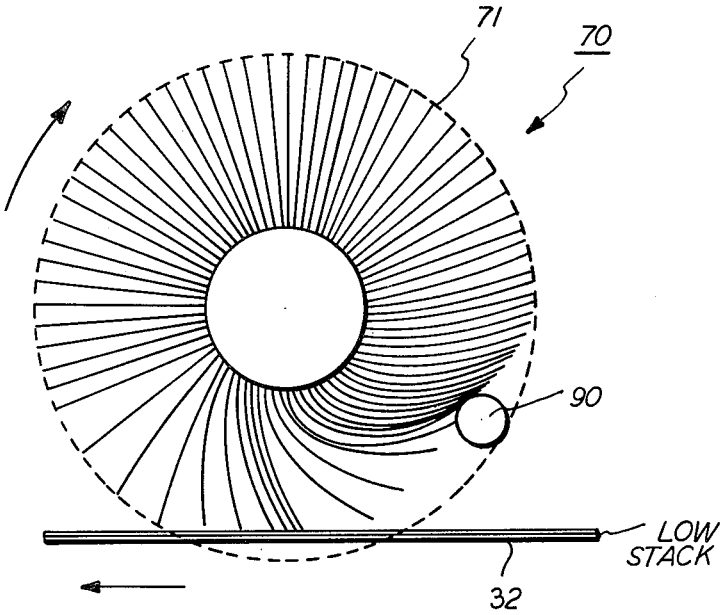
FIG. 4 is an enlarged partial side view of another embodiment of an enhanced inertial separator and transporter paddle wheel system which includes a flicker bar.

In reference to the alternative embodiment shown in FIG. 4, a flicker bar 90 is shown serving as an energy storage means. As the paddle wheel 70 rotates, blades 71 are bent backward as they contact flicker bar 90. Continued rotation of the paddle wheel cause the blades to flick from the bar against the top sheet in the stack. The high acceleration and concomitant high impact of the blades due to the storage of blade potential energy by the flicker bar causes the top sheet in stack 30 to separate from the next adjacent sheet.

The above described embodiments of the present invention show how paddle wheel performance can be enhanced by storing potential energy in the blades through controlled bending of the blades by an inward spiraling track which retards the blade tip motion and then allows it to spring forward just prior to and during sheet contact. The spiral track of the energy storage means provides the following benefits: (1) potential energy is stored in each blade which may be released in a constructive way during blade to paper contact, (2) positive control is extended over the natural vibration of a spinning paddle wheel blade. The track releases the blade so that its vibration aids in feeding the sheet, whereas prior designs have largely uncontrolled blade vibration with random beneficial/deleterious effects, (3) the blade is bent in the track in a controlled gentle way, avoiding unnecessary inertial and frictional loads which lead to blade wear, (4) the height of the track can be adjusted to achieve the task of separating the top sheet in a stack from the rest or transport the sheet or a combination of both, (5) high acceleration of the blade as it leaves the energy storage means and its high impact against the top sheet in a stack serves to enhance the separation of the top sheet from the stack.

In conclusion, an enhanced paddle wheel inertial separator and transporter is disclosed that comprises a paddle wheel working in conjunction with an energy storage mechanism to improve paddle wheel feeder reliability. As the paddle wheel is rotated, blades attached to the hub of the paddle wheel are bent by the gentle spiral of the energy storage means and released to spring forward just prior to and during sheet contact. The energy storage means thus stores potential energy in the blades and allows it to be converted into kinetic energy as the blades leave the storage means. The blades hit the paper to be fed with peak inertial force due to acceleration of the blades and thereby enhances the feeder separation capabilities.

It is evident therefore, that there has been provided in accordance with the present invention, a paper feeding system which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. A copier having a photoreceptor, an imaging system for imaging documents on the photoreceptor, a predetermined paper path, a multi-bladed paddle wheel in a feeder for forwarding sheets individually from a stack of sheets into said paper path, characterized by an inwardly spiraling track positioned adjacent the paddle wheel and adapted to extend therearound at least a quadrant of a circle, said inwardly spiraling track increasingly compresses a plurality of the blades of the paddle wheel simultaneously as the paddle wheel is rotated to retard blade tip motion and then allow the blades to individually spring forward just prior to and during sheet contact in order to avoid undue inertial and frictional loads upon the blades and thereby reduce blade wear to a minimum.

* * * * *